US008328664B2

(12) United States Patent
Krause

(10) Patent No.: US 8,328,664 B2
(45) Date of Patent: Dec. 11, 2012

(54) MOTION TACKLER

(75) Inventor: Harry W. Krause, Lake Wylie, SC (US)

(73) Assignee: Rae Crowther Company, Rock Hill, SC (US)

( * ) Notice: Subject to any disclaimer, the term of this patent is extended or adjusted under 35 U.S.C. 154(b) by 225 days.

(21) Appl. No.: 12/950,320

(22) Filed: Nov. 19, 2010

(65) Prior Publication Data

US 2011/0124443 A1 May 26, 2011

Related U.S. Application Data

(60) Provisional application No. 61/263,504, filed on Nov. 23, 2009.

(51) Int. Cl.
*A63B 69/34* (2006.01)
*A63B 69/00* (2006.01)

(52) U.S. Cl. ..... 473/445; 473/441; 473/438

(58) Field of Classification Search ..... 473/422, 473/438–445; 482/121, 129; 434/251; D21/698, D21/788

See application file for complete search history.

(56) References Cited

U.S. PATENT DOCUMENTS

| | | | | | |
|---|---|---|---|---|---|
| 2,440,577 | A * | 4/1948 | Denby | 473/441 |
| 3,062,548 | A * | 11/1962 | Foster et al. | 473/445 |
| 3,326,553 | A * | 6/1967 | Forrest | 473/445 |
| 3,332,683 | A * | 7/1967 | Rand | 473/441 |
| 3,927,879 | A * | 12/1975 | Long et al. | 473/441 |
| 3,997,160 | A * | 12/1976 | George | 473/444 |
| 4,140,315 | A * | 2/1979 | Page, Jr. | 473/445 |
| 4,447,056 | A * | 5/1984 | Dalton | 473/442 |
| 5,743,821 | A * | 4/1998 | Wirachowski | 473/441 |
| 6,309,327 | B1 * | 10/2001 | Hallberg | 482/90 |
| 6,685,581 | B2 | 2/2004 | Krause | |
| 6,761,650 | B1 * | 7/2004 | Dettmann | 473/445 |
| 6,942,585 | B1 | 9/2005 | Krause | |
| 6,988,965 | B2 | 1/2006 | Krause | |
| 7,527,568 | B2 * | 5/2009 | Joseph | 473/441 |
| D659,779 | S * | 5/2012 | Gray | D21/788 |
| 2002/0193185 | A1 * | 12/2002 | Pendlebury | 473/445 |

* cited by examiner

*Primary Examiner* — Mitra Aryanpour
(74) *Attorney, Agent, or Firm* — Joseph T. Guy; Nexsen Pruet, LLC

(57) ABSTRACT

A motion tackler for simulating an opponent during tackle training. The motion tackler has an elongated frame with a first side and a second side. A dummy module is attached to the first side of the elongated frame. A handle frame is attached to the second side of the elongated frame. A plurality of wheels are attached to the elongated frame. The motion tackler further has a resistance bar capable of engaging with the ground upon the dummy module being lifted.

23 Claims, 4 Drawing Sheets

MOTION TACKLER

CROSS-REFERENCE TO RELATED APPLICATION

The present invention claims priority to pending U.S. Provisional Patent Application No. 61/263,504 filed Nov. 23, 2009.

BACKGROUND

The present invention is related to an improved tackling sled and an improved method of teaching the art of tackling. More specifically, the present invention is directed to a tackling sled which can effectively mimic the motion of an opposing player, either being tackled or a blocker, to closer resemble game situations.

The art of tackling is a critical element to the sport of football. Practicing tackling can be broadly described as being within one of two categories, live drills and through the use of tackling sleds. Tackling sleds are highly advantageous for teaching tackling technique yet it is virtually impossible to mimic live action with a tackling sled. Examples of tackling sleds are provided in U.S. Pat. No. 6,685,581; U.S. Pat. No. 6,942,585 and U.S. Pat. No. 6,988,965 each of which is incorporated herein by reference.

Tackling sleds are described as such due to the historical use of skis wherein the player pushes the tackling sled along the ground on the skis. There are a variety of designs, not all of which include skis, including sleds for single tacklers, multiple tacklers, sleds which allow a coach to ride on the sled for instruction purposes and the like. A common problem with tackling sleds is the rigid nature of the motion. Unlike an actual opponent a tackling sled is typically static and provides no ability to mimic an opponent moving prior to contact and, particularly, there is no ability to mimic an opponent moving in response to the oncoming tackler.

Other systems include suspended bags and the like but the motion of these after contact is inadequate to mimic an opponent and often leads to poor technique due to the tackler learning to respond to the unnatural motion of the suspended device.

Live drills, with an opponent, do allow the tackler to practice under "game-like" conditions but this can be dangerous since the purpose of the drill is to teach, and practice, proper technique to avoid injury. If the technique is improper an injury is more likely to occur.

There has been an ongoing desire in the art for a tackling sled which allows the coach to more accurately mimic game situations yet which is controlled to minimize injury to the tackler or an opponent.

SUMMARY

It is an object of the invention to provide a motion tackler wherein the motion tackler can be mobilized to mimic an opponent during a tackling drill.

It is another object of the invention to provide a method of teaching the art of tackling while minimizing the risk of injury.

A particular feature of the invention is the simplicity of design.

These and other advantages, as will be realized, are provided in a motion tackler. The motion tackler has an elongated frame with a first side and a second side. A dummy module is attached to the first side of the elongated frame. A handle frame is attached to the second side of the elongated frame. A plurality of wheels are attached to the elongated frame. The motion tackler further has a resistance bar capable of engaging with the ground upon the dummy module being lifted.

Yet another embodiment is provided in a method for teaching tackling. The method includes: providing a motion tackler comprising: an elongated frame with a first side and a second side; a dummy module attached to the first side of the elongated frame; a handle frame attached to the second side of the elongated frame; a plurality of wheels attached to the elongated frame; and a resistance bar capable of engaging with ground upon the dummy module being lifted. A trainer grasp the handle frame of the motion tracker and moves the motion tracker along a path. The motion tackler is released by the trainer and engaged by a tackler who grasp the dummy module causing the resistance bar to contact the ground thereby providing resistance against movement of the motion tackler away from the tackler.

DETAILED DESCRIPTION

Described herein is a motion tackler, and method of teaching tackling, wherein the motion tackler can be mobilized to mimic a moving opponent. In particular, the motion tackler can be moved to mimic movement with opposing velocity, parallel velocity, varying velocity or combinations thereof at the discretion of the trainer.

The invention will be described with reference to the various figures which are provided for the purposes of describing the invention but which are not limiting. Throughout the various figures similar elements will be numbered accordingly.

Figure 1:
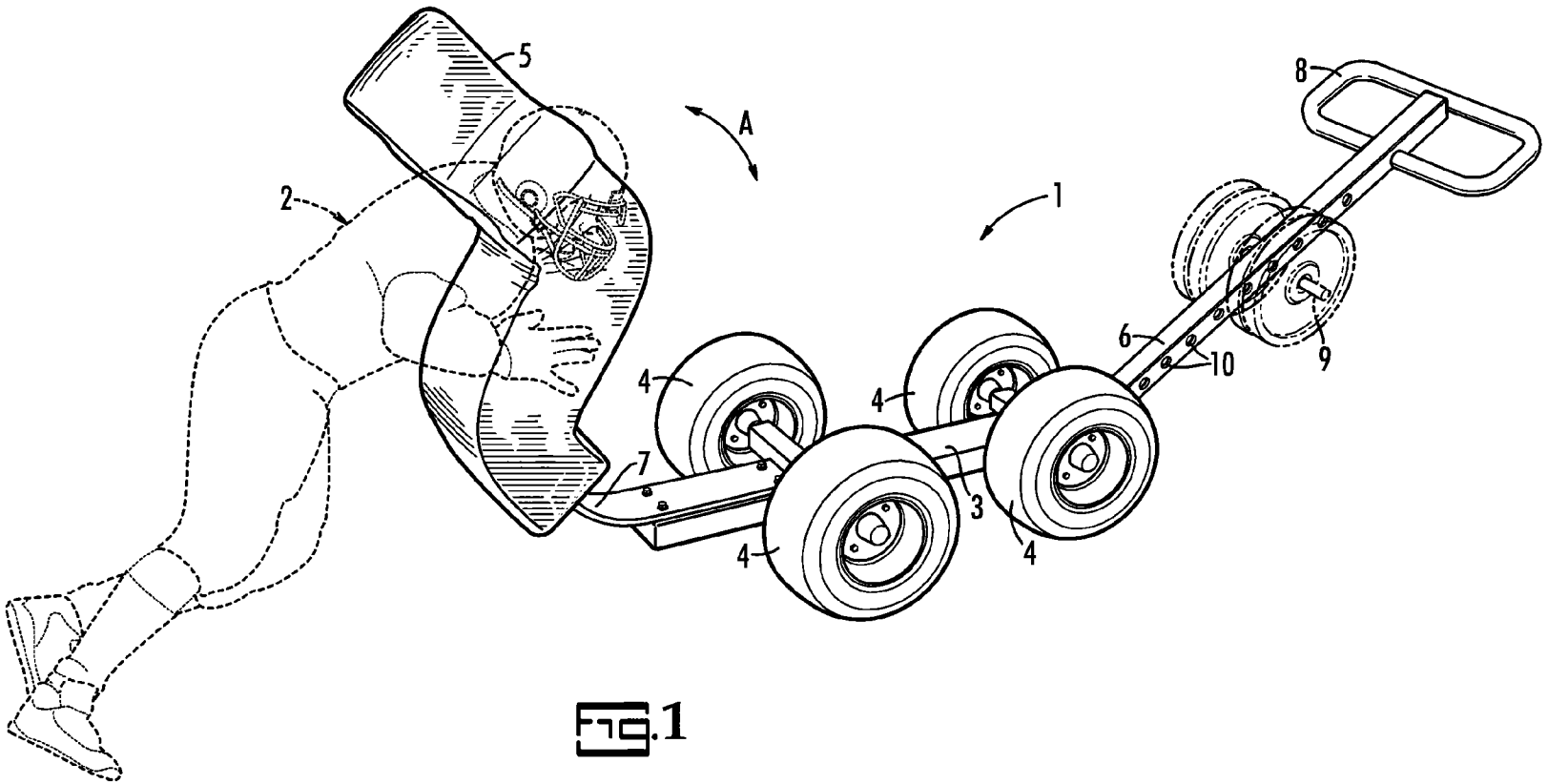
FIG. 1 is a perspective view of an embodiment of the invention.

An embodiment of the invention is illustrated in FIG. 1. In FIG. 1, the motion tackler, generally represented at 1, is illustrated at the point of attack by a tackler, 2, shown in phantom view for clarity. The motion tracker comprises a generally elongated frame, 3, with a multiplicity of wheels, 4, attached thereto. The wheels are preferable spaced to allow the motion tackler to move freely on turf but separated so as to allow the motion tackler to be tipped upon contact by a tackler. Four wheels are preferred. Though not limited thereto, pneumatic tires on a wheel attached to a rotating hub is most preferred. On one end of the motion tackler is mounted a dummy module, 5. The dummy module is preferably a padded assembly with dimensions, height and width, chosen to approximate a person running. In a particularly preferred embodiment the dummy module is player shaped as described in U.S. Pat. No. 6,988,965 which is incorporated herein by reference. It is particularly preferred that the dummy module be attached to the elongated frame, 3, by flexible steel, 7, which is preferably rectangular in cross-section. A handle frame, 6, extends from the elongated frame, preferably, in a direction opposite from the dummy module, 5. The handle frame preferable extends upward such that the end furthest from the elongated frame is a comfortable height for pushing by a trainer. The handle angle, relative to the elongated frame, and length can be adjustable. A handle grip, 8, allows the device to be easily pushed, pulled or otherwise moved. An optional, but preferred weight assembly, 9, is attached to the handle frame, 6, thereby allowing the application of weights, shown in phantom, thereby increasing the weight of the motion tackler and altering the resistance during engagement as will be more readily appreciated after further discussion below. The distance between the weight assembly and the elongated frame is preferably adjustable such as by utilizing a series of weight assembly attachment voids, 10, which increase the leverage with distance from the elongated frame.

Figure 2:
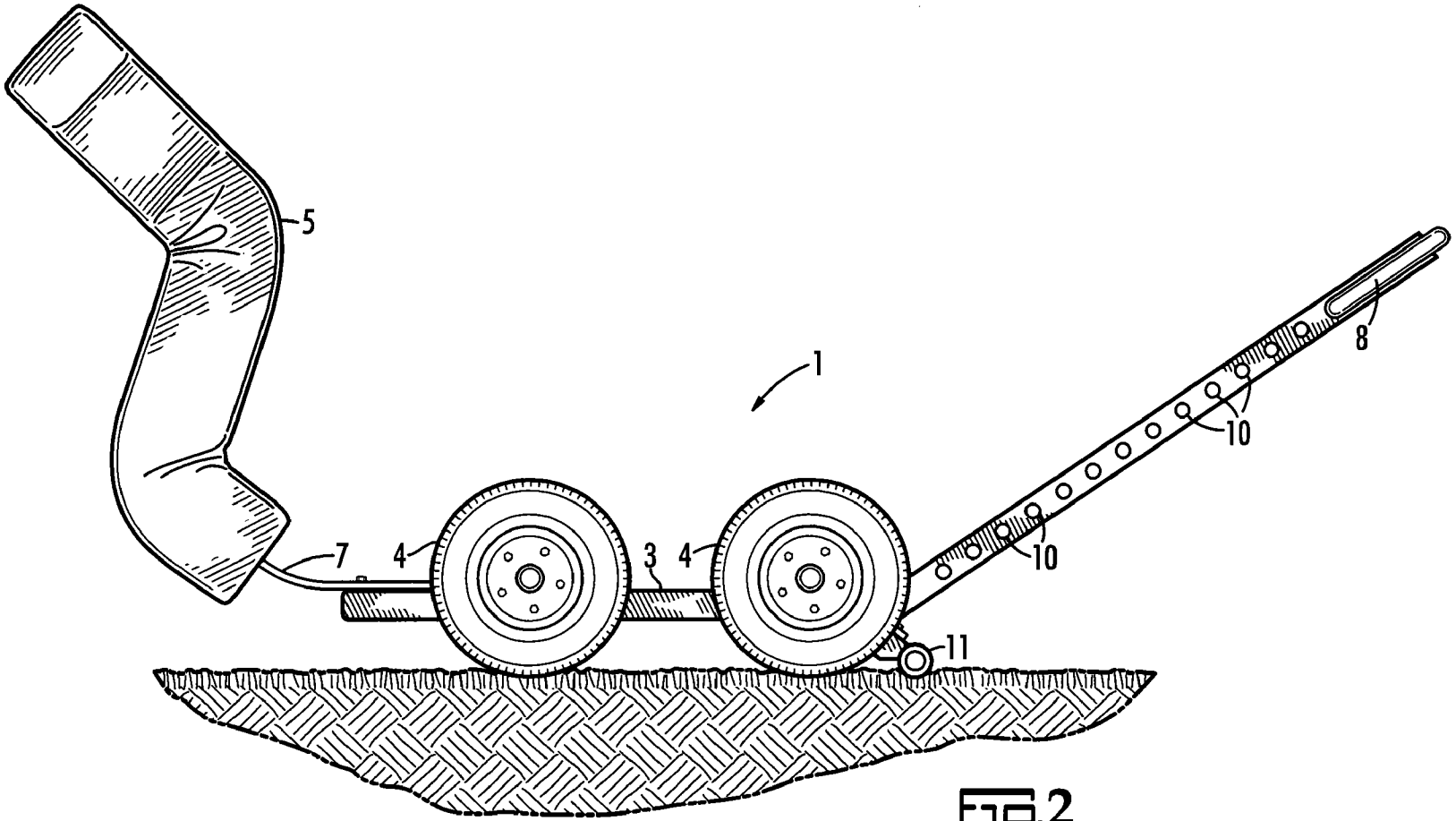
FIG. 2 is a side view of an embodiment of the invention.

A side view of the motion tackler is provided in FIG. 2. In FIG. 2, the similar elements are numbered in accordance with FIG. 1 and will not be further described here. A resistance bar, 11, is attached, preferably, to the elongated frame opposite the dummy module. The resistance bar is preferably situated to provide minimal contact with the ground when the wheels are in contact with the ground, however, as the tackler engages the motion tackler the dummy module is elevated thereby bringing the resistance bar into contact with the ground wherein the resistance increases as the dummy module is lifted. It is most preferred that the resistance bar contact the ground when the dummy module is lifted by about three inches. This provides resistance upon contact thereby allowing the tackler to simulate tackling an opposing player to the ground as will be described in more detail below. This allows the mobile tackler to move relatively freely towards the tackler, with the dummy module forward, yet provides resistance to moving away from the tackler upon contact. If the dummy module is lifted a sufficient amount the entire weight of the motion tackler, plus any force applied by the tackler, is applied to the resistance bar.

With further reference to FIG. 1, weights can be incorporated to increase the total weight thereby increasing the resistance between the ground and the resistance bar. Furthermore, weight can be applied to decrease the force required to elevate the dummy module to bring the resistance bar into increased resistive contact with the ground.

Figure 3:
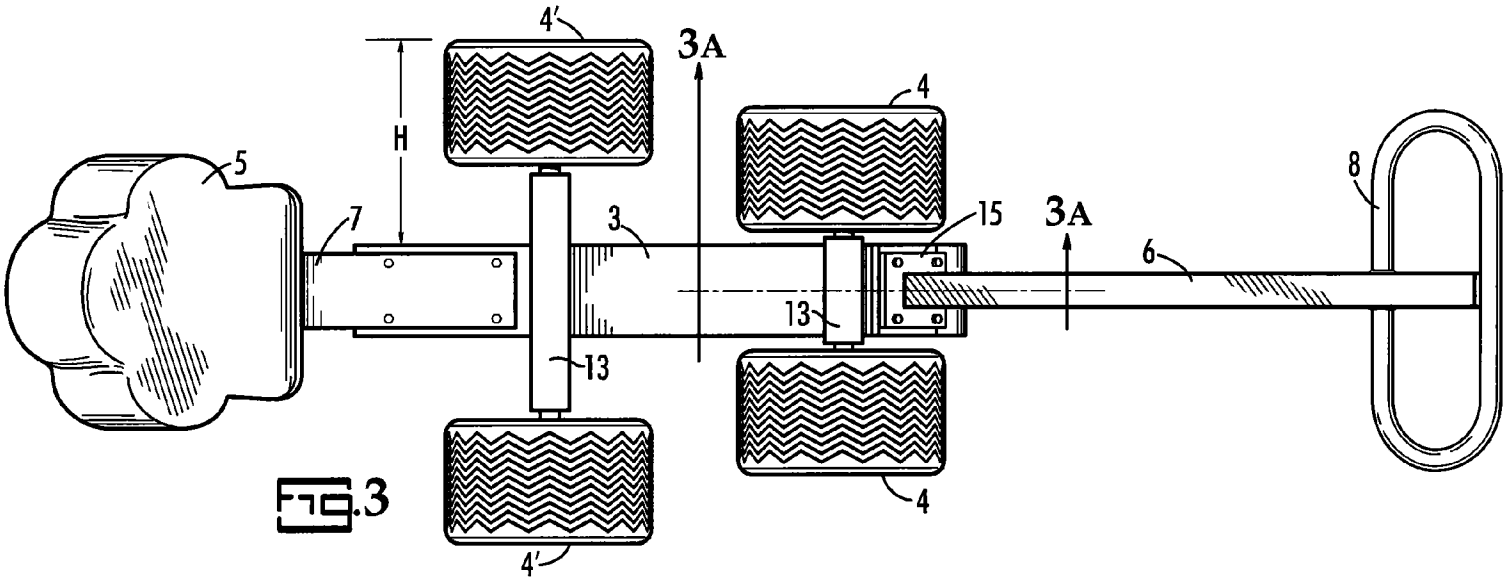
FIG. 3 is a top view of an embodiment of the invention.
Figure 3A:
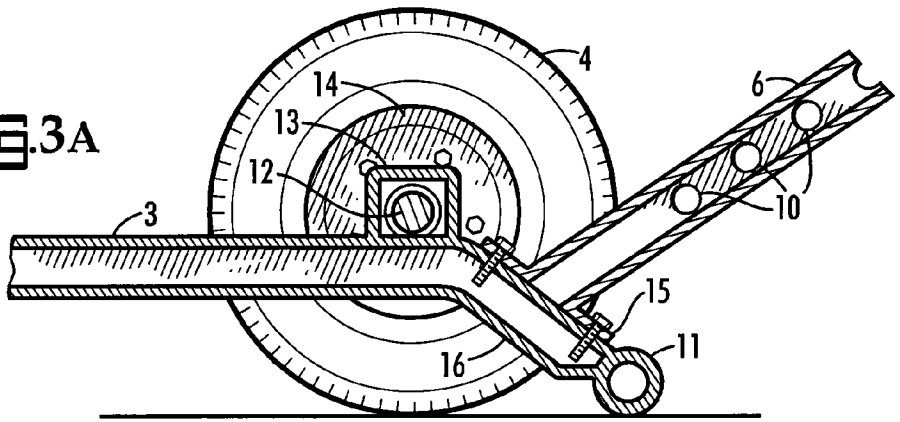
FIG. 3A is a cross-sectional partial view taken along line 3A-3A of FIG. 3.

An embodiment of the motion tackler is provided in top view in FIG. 3. In FIG. 3, the previously described elements are numbered accordingly. In the embodiment of FIG. 3 the forward wheels, 4', which are closest to the dummy module are separated more than the rear wheels, 4, which are closest to the handle frame, 6. This assist in drills as will be described further herein. FIG. 3A is a cross-sectional view taken along line 3A-3A of FIG. 3. The hubs, 14, of the wheels are preferably attached to an axle, 12, which is attached to the elongated frame with a housing, 13. The method of attaching the wheels is not particularly limiting. The handle frame, 6, is preferably attached by a bracket, 15, which is preferably integral to the handle frame, such as welded, and attached to the elongated frame by threaded members or the like. The resistance bar, 11, is preferably integral to the frame and, in a preferred embodiment is integral to a downward offset, 16, of the frame. One of skill in the art could assembly the motion tackler in a different fashion without departure from the invention.

A particular feature of the invention will be described with further reference to FIGS. 1 and 4-7. As the tackler, 2, contacts the motion tackler, 1, the forward wheels are elevated thereby decreasing the sideways stability provided by the wider forward wheels. This allows the tackler to rotate the motion tackler from side-to-side as indicated by arrow A. In use the tackler engages the motion tackler by contact with the dummy module thereby elevating the dummy module such that the motion tackler is in contact with the ground at the resistance bar and possibly the rearward wheels. The tackler can then twist the motion tackler to his right or left to tilt the motion tackler completely to its side with the axle at a large angle, such as 90° with the ground thereby simulating contacting an opposing player and going through a complete tackle.

Figure 4:
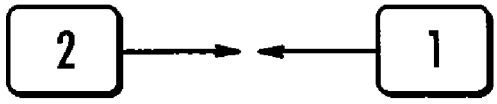
FIGS. 4-7 illustrate various embodiments of the method of use.
Figure 5:
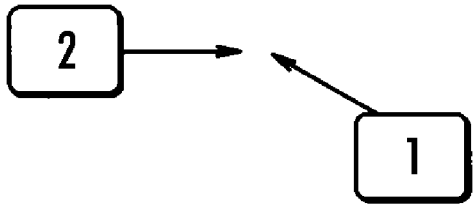
Figure 6:
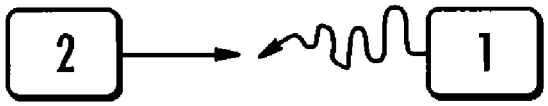
Figure 7:
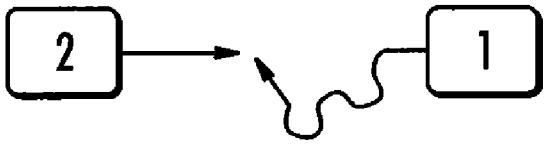

As illustrated in FIGS. 4-7 the approach between the tackler, 2, and motion tackler can be altered to simulate various approach angles. A trainer would grasp the handle grip and push the motion tackler in a desired direction. In FIG. 4, the motion may be directly towards the tackler, 2. In FIG. 5 the motion may be at an angle relative to the tackler. In FIG. 6, the motion may be non-linear and in FIG. 7 the motion may be some combination of motions to simulate an opposing player attempting to avoid being blocked.

The motion tackler allows for a device wherein the trainer can roll the motion tackler at a player. The motion tackler is then contacted by the player and tackled to the ground. The trainer may release the motion tackler prior to contact or at the point of contact. In another embodiment, the trainer may maintain control of the motion tackler after contact to further simulate resistance to tackling. The motion tackler bridges the gap between static tackling and live game speed tackling. The speed and direction of the motion tackler can be determined by a trainer thereby allowing for more specific training in proper technique under controlled conditions. There is virtually no limit to the direction or force which can be applied since there is no tether, cable or other limiting device.

The motion tackler is particularly useful for standard drills. The motion tackler can be pushed from 5, 10 or 15 yards away, for example, to simulate straight, angle and sideline tackling. The motion tackler can be used to simulate a linebacker, a defensive end, an outside linebacker, and various plays can be simulated such as an option, veer or I-option. Furthermore, the motion tackler can be used for conditioning wherein the tackler simply pushes the motion tackler to strengthen various muscles typically used during a tackle.

The invention has been described with specific reference to the preferred embodiments without limitation thereto. One of skill in the art could arrive at various improvements and alterations without departure from the scope of the invention which is more specifically set forth in the claims appended hereto.

The invention claimed is:

1. A motion tackler comprising:
an elongated frame with a first side and a second side;
a dummy module attached to said first side of said elongated frame;
a handle frame attached to said second side of said elongated frame;
a plurality of wheels attached to said elongated frame; and
a resistance bar capable of engaging with ground upon said dummy module being lifted.

2. The motion tackler of claim 1 comprising forward wheels and rearward wheels.

3. The motion tackler of claim 2 wherein said forward wheels are separated by a distance which is larger than a separation of said rearward wheels.

4. The motion tackler of claim 1 further comprising a handle grip attached to said handle frame.

5. The motion tackler of claim 1 further comprising a weight assembly.

6. The motion tackler of claim 5 wherein said weight assembly is attachable to said handle frame.

7. The motion tackler of claim 6 wherein said weight assembly is attachable to multiple locations on said handle frame.

8. The motion tackler of claim 1 wherein said resistance bar contacts ground when said dummy module is lifted by at least 3 inches.

9. A method for teaching tackling comprising:

providing a motion tackler comprising:

an elongated frame with a first side and a second side;

a dummy module attached to said first side of said elongated frame;

a handle frame attached to said second side of said elongated frame;

a plurality of wheels attached to said elongated frame; and a resistance bar capable of engaging with ground upon said dummy module being lifted;

grasping said handle frame of said motion tracker;

moving said motion tracker along a path;

releasing said motion tracker; and engaging a tackler to grasp said dummy module wherein upon said grasping said resistance bar contacts ground and provides resistance against movement of said motion tackler away from said tackler.

10. The method for teaching tackling of claim 9 wherein said releasing is prior to said engaging a tackler.

11. The method for teaching tackling of claim 9 wherein said motion tackler comprises forward wheels and rearward wheels.

12. The method for teaching tackling of claim 11 wherein said forward wheels are separated by a distance which is larger than a separation of said rearward wheels.

13. The method for teaching tackling of claim 9 further comprising a handle grip attached to said handle frame.

14. The method for teaching tackling of claim 9 further comprising a weight assembly.

15. The method for teaching tackling of claim 14 wherein said weight assembly is attachable to said handle frame.

16. The method for teaching tackling of claim 15 wherein said weight assembly is attachable to multiple locations on said handle frame.

17. The method for teaching tackling of claim 9 wherein said resistance bar contacts ground when said dummy module is lifted by at least 3 inches.

18. The method for teaching tackling of claim 9 wherein said tackler tilts said motion tackler to a side after said engaging.

19. The method for teaching tackling of claim 9 comprising moving said motion tackler in a straight path.

20. The method for teaching tackling of claim 19 comprising moving said motion tackler towards said tackler.

21. The method for teaching tackling of claim 19 comprising moving said motion tackler at an angle relative to a path of said tackler.

22. The method for teaching tackling of claim 9 comprising moving said motion tackler in a non-linear path.

23. The method for teaching tackling of claim 9 comprising moving said motion tackler in path including a non-linear path and a straight path.

* * * * *